US005906160A

United States Patent [19]

Galassi et al.

[11] Patent Number: 5,906,160

[45] Date of Patent: May 25, 1999

[54] METHOD OF ENSURING SEALING BETWEEN AN INKING CUP AND A PLATE IN A PAD-TRANSFER PRINTING MACHINE

[75] Inventors: Angelo Galassi, deceased, late of Visconti-Novara, by Julia E. Taylor, Yolande Galassi, heiress; Richard Galassi, heir, Milan, both of Italy

[73] Assignee: Tampograf S.a.s. di J.E. Taylor & Co., Milan, Italy

[21] Appl. No.: 08/619,817

[22] Filed: Mar. 15, 1996

[30] Foreign Application Priority Data

Mar. 16, 1995 [IT] Italy ..... MI95A0513

[51] Int. Cl.[6] ..... B41M 7/00; B41F 17/00

[52] U.S. Cl. ..... 101/335; 101/163

[58] Field of Search ..... 101/335, 163, 101/167, 123, 109, 170, 35, 44; 400/328, 335

[56] References Cited

U.S. PATENT DOCUMENTS

| | | | |
|---|---|---|---|
| 5,363,761 | 11/1994 | Galassi | 101/163 |
| 5,469,786 | 11/1995 | Harris | 101/163 |
| 5,537,921 | 7/1996 | Ladner et al. | 101/35 |

*Primary Examiner*—Eugene H. Eickholt

*Attorney, Agent, or Firm*—Ostrolenk, Faber, Gerb & Soffen, L.L.P.

[57] ABSTRACT

In a method which ensures unexceptionable sealing between a plate extending on a plate-holding table of a pad-transfer printing machine and an inking cup movable along the plate in contact with a face thereof, the plate is deformed pneumatically towards the inside of the cup.

9 Claims, 3 Drawing Sheets

METHOD OF ENSURING SEALING BETWEEN AN INKING CUP AND A PLATE IN A PAD-TRANSFER PRINTING MACHINE

DESCRIPTION

The present invention relates to a method of ensuring sealing between a plate disposed above a plate-holding table of a pad-transfer printing machine, and an inking cup movable along the table in pressing contact with an upper face of the plate.

As is known, in pad-transfer printing machines, there is a need to ensure sealing between the plate and the inking cup and, more precisely, between the plate and the peripheral lip which defines the cup and acts as a doctor blade.

The better the sealing is, the better the inking carried out on the plate, in the sense that the surface of the plate not affected by the wells is left cleaner and drier by the cup.

In order to improve sealing, it has been proposed to increase the force with which the cup is kept in pressing contact with the plate. However, this proposal has the disadvantage of increasing wear both of the lip which acts as a doctor blade and of the surface of the plate.

The problem upon which the present invention is based is that of devising a method of the type specified which has characteristics such as to overcome the aforesaid disadvantage.

This problem is solved by a method which is characterized in that it comprises the step of pneumatically deforming the plate towards the inside of the cup.

Figure 2:
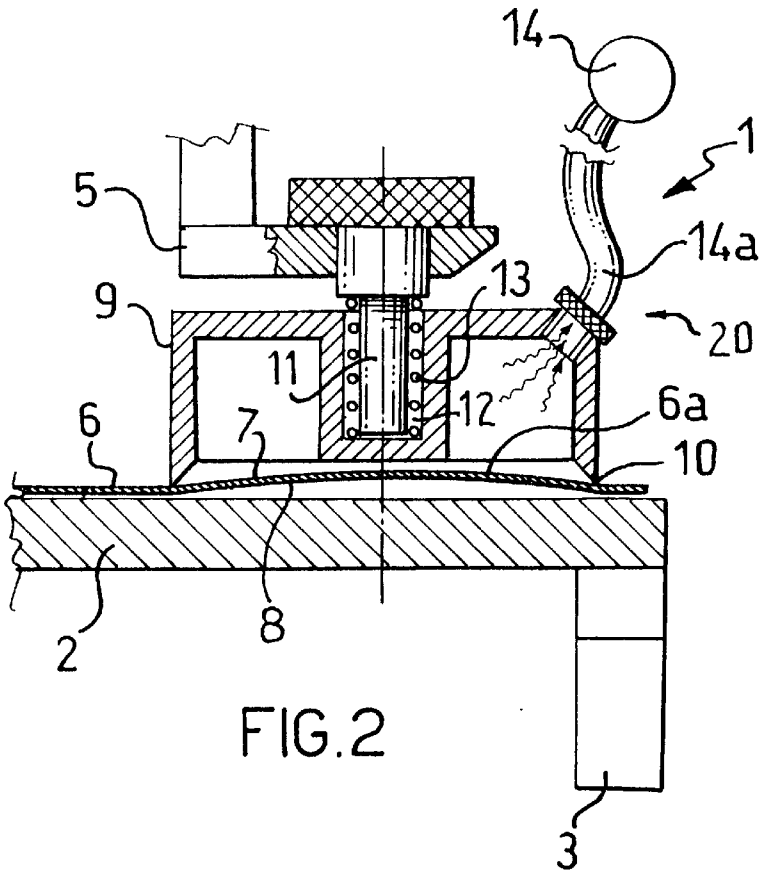
Figure 1:
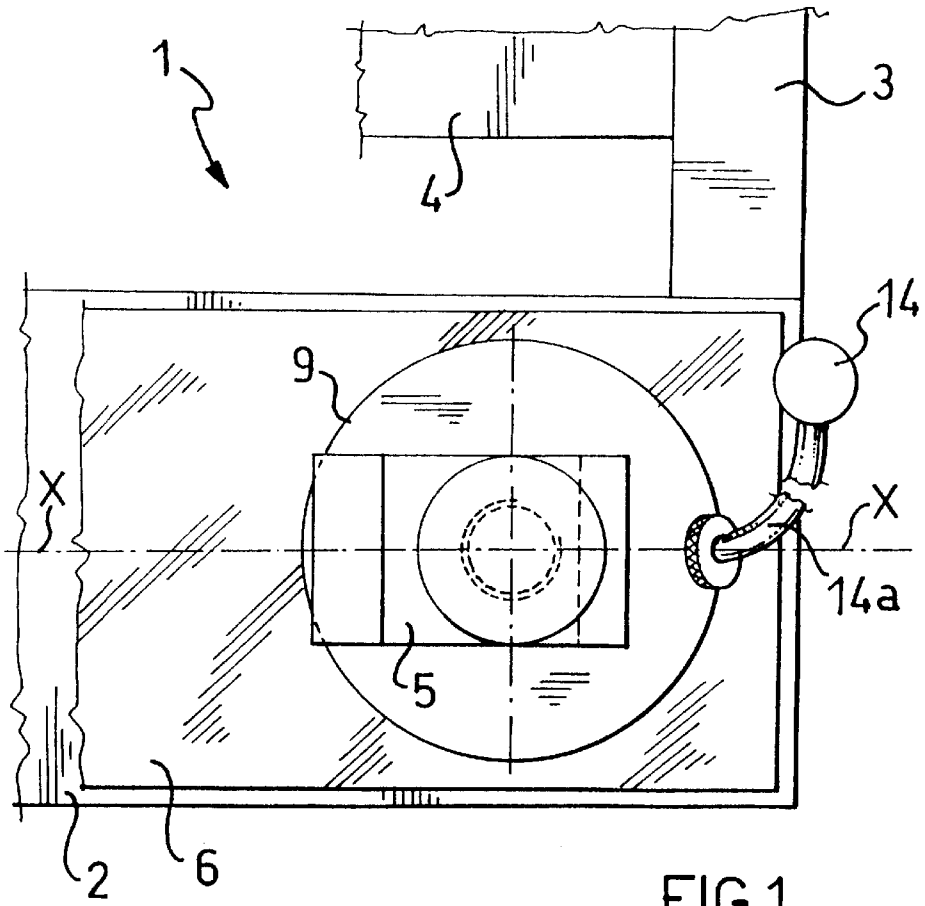
Figure 3:
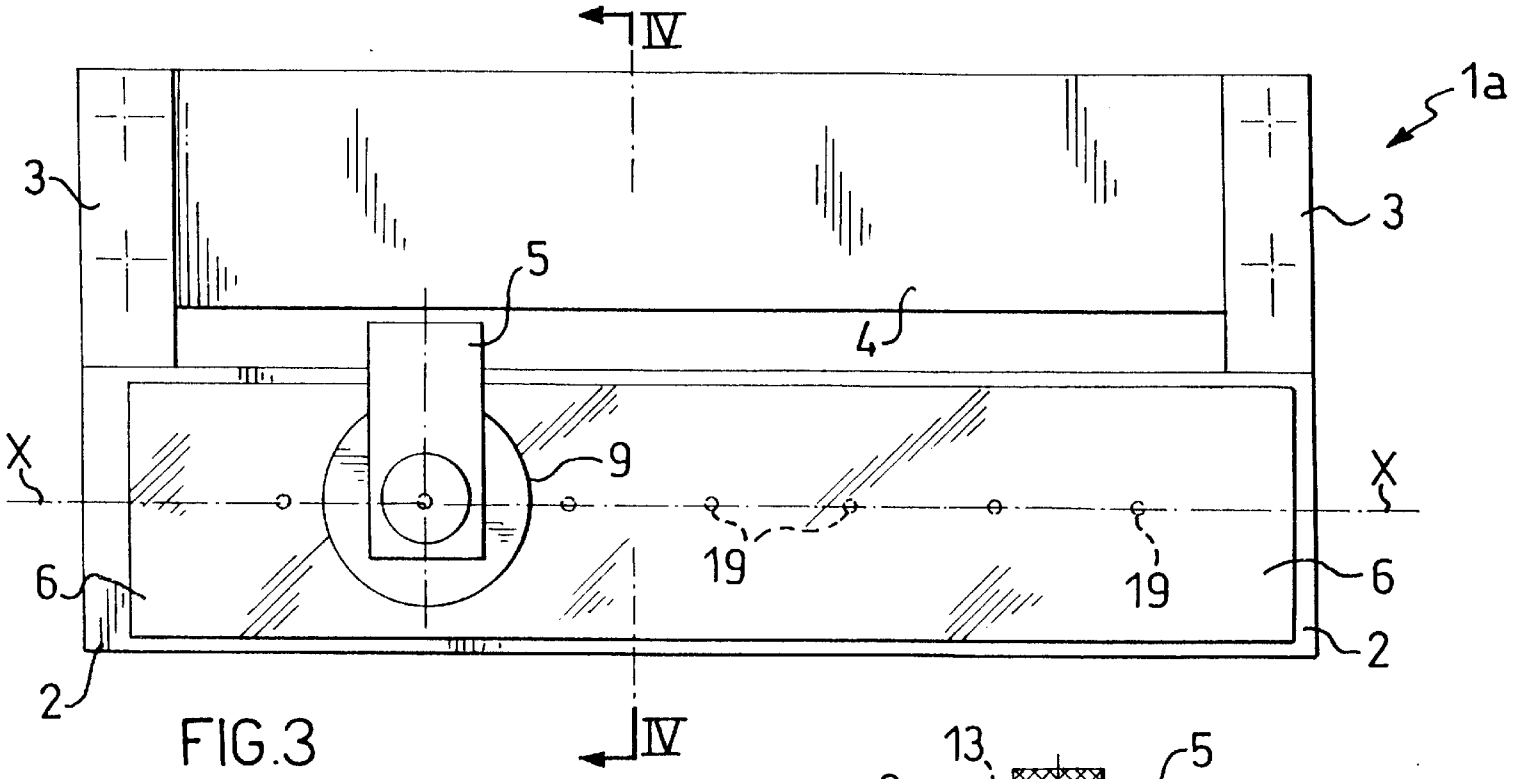
Figure 4:
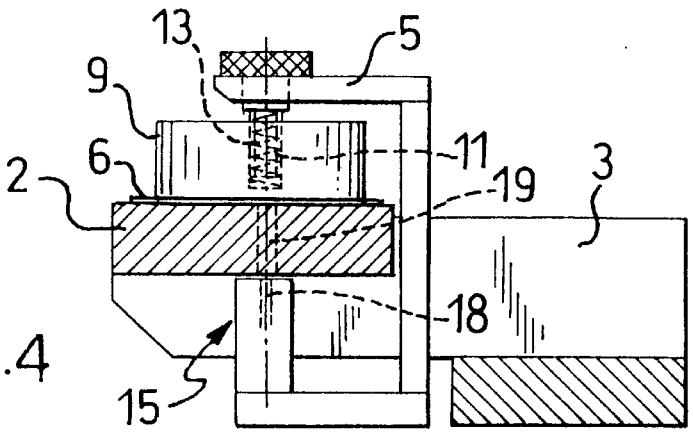
Figure 5:
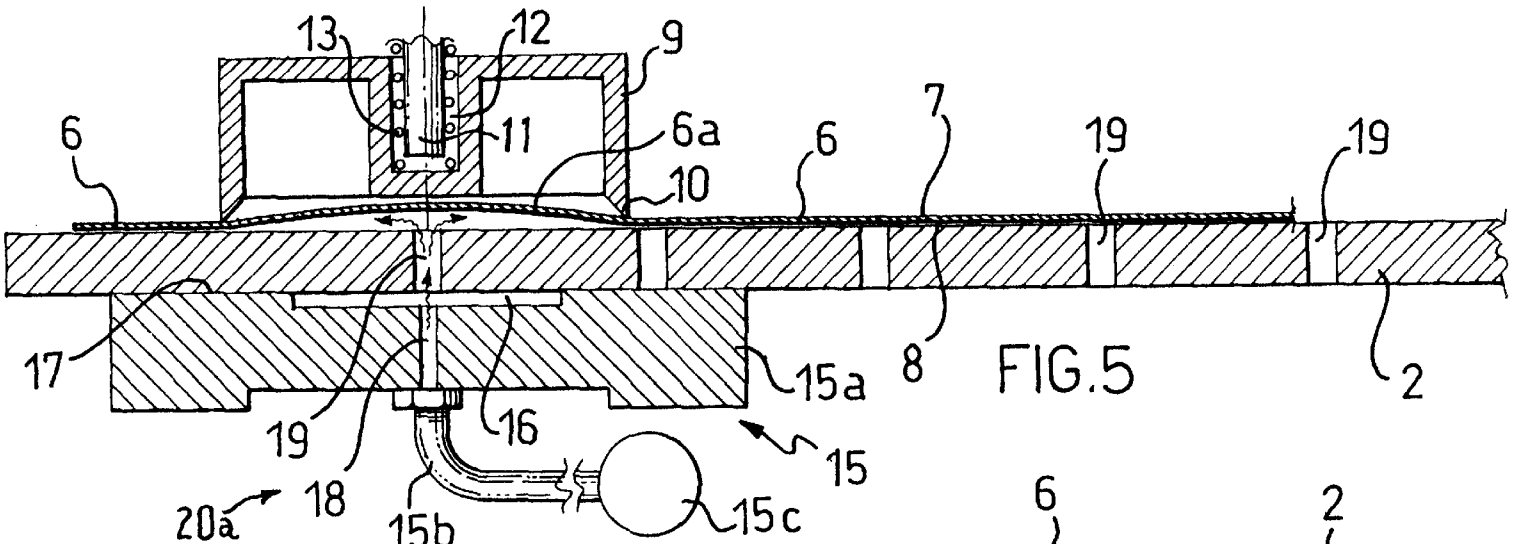
Figure 6:
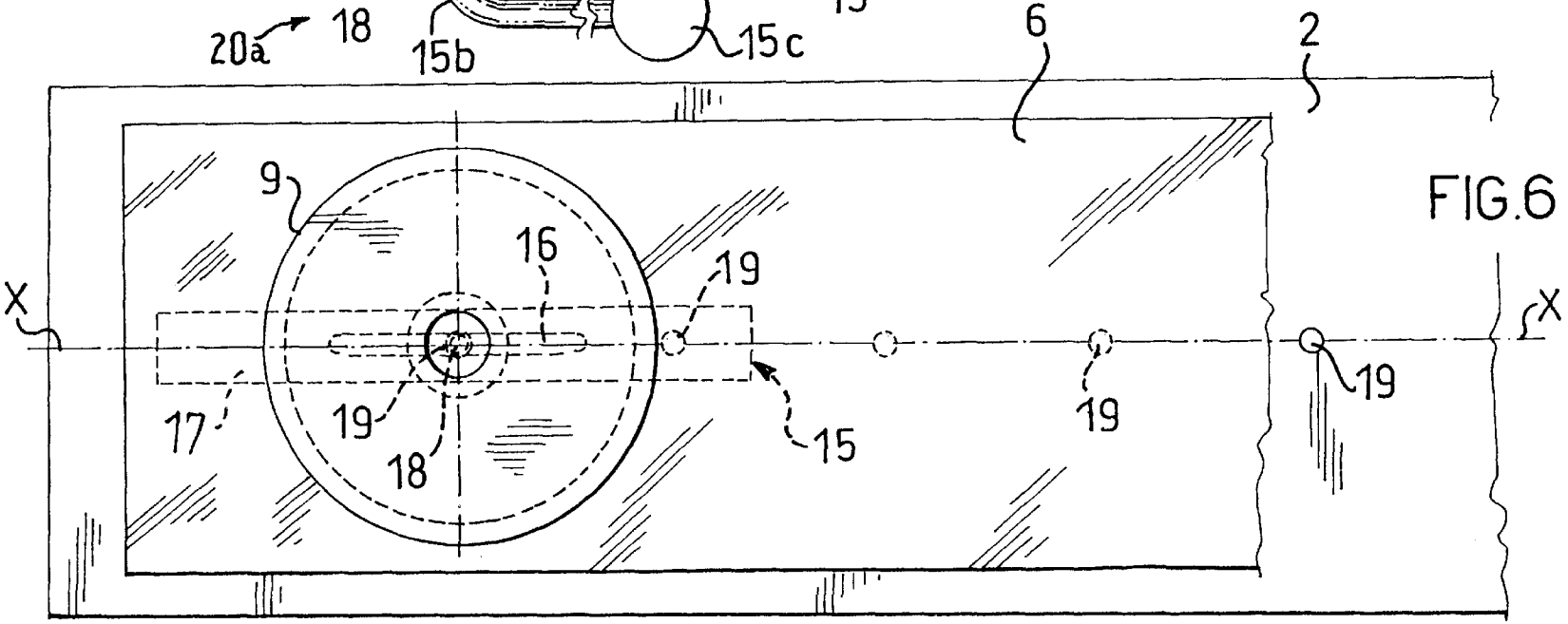

Further characteristics and the advantages of the method according to the present invention will become clear from the following description of an example of the implementation thereof, given with reference to an inking device of a pad-transfer printing machine described with reference to embodiments thereof given by way of non-limiting example with reference to the appended drawings, in which:

FIG. 1 is a plan view of a first embodiment of an inking device according to the invention, FIG. 2 is a partially-sectioned elevational view of the inking device of FIG. 1, taken on the line II—II, FIG. 3 is a plan view of a second embodiment of an inking device according to the invention, FIG. 4 is a section taken on the line IV—IV of the inking device of FIG. 3, FIG. 5 is a section taken on the line V—V of the inking device of FIG. 3, and FIG. 6 is a plan view of a detail of the inking device of FIG. 3, on an enlarged scale.

With reference to the appended drawings, an inking device of a pad-transfer printing machine is generally indicated 1.

The inking device 1 comprises a plate-holding table 2 which is rectangular and elongate in a longitudinal direction X—X and is supported at its ends by means of arms 3 on a rule 4 which can be fixed on the framework, not shown, of the pad-transfer printing machine.

A slide 5 is movable along the plate-holding table 2, the slide 5 being supported and moved by the pad-transfer printing machine, in known manner.

A plate 6 extending above the plate-holding table 2 has an upper face 7 and a lower face 8. The lower face 8 of the plate 6 bears on the plate-holding table 2, and an inking cup 9 is in pressing contact with the upper face 7 of the plate.

The bell-shaped inking cup 9, filled with ink, has a peripheral lip 10 which is in pressing contact with the upper surface 7 of the plate, like a doctor blade. The inking cup 9 is supported by the slide 5 by means of a pin 11 projecting from the slide 5 and engaged in a seat 12 in the cup.

A spring provided between the pin 11 and the seat 12 brings about the pressing contact of the cup with the plate, with a predetermined force.

The inking device 1 comprises pneumatic means 20 active on the plate 6 in order to deform it towards the inside of the cup. The pneumatic means 20 comprise a vacuum source 14, for example, a vacuum pump, a venturi tube, or the like. The vacuum source 14 can create a vacuum and is in fluid communication with the cup 9 by means of a pipe 14*a*.

In operation, by virtue of the vacuum formed inside the cup, a portion of the plate, indicated 6*a*, delimited by the cup, is deformed towards the inside of the cup, taking up a domed shape with an angular point in the plate adjacent the peripheral lip 10. This deformation of the plate and, in particular, the angular point, brings about an unusual increase in the sealing between the lip and the plate.

An inking device 1*a* in accordance with a second embodiment of the invention is described with reference to FIGS. 3, 4, 5 and 6.

The parts of the device 1*a* which are structurally and functionally similar to those of the device 1 are marked with the same reference numerals and are not described below in order not to make the present description unnecessarily lengthy.

The inking device 1*a* according to the invention comprises pneumatic means 20*a* active on the plate in order to deform it towards the inside of the cup. The pneumatic means 20*a* comprise a compressed-air source, generally indicated 15, which is active beneath the plate-holding table 2 and is movable with the cup. In particular, the compressed-air source 15 takes the form of a sliding distributor block 15*a* which has an upper face having a chamber 16 and defined by a lip 17 in sliding contact with the plate-holding table 2.

The chamber 16 is in fluid communication with an air compressor 15*c* by means of a hole 18, to which a pipe 15*b* is connected.

A plurality of holes 19 is formed in the plate-holding table 2, the holes being distributed uniformly along the plate-holding table and putting the compressed-air source into communication with the lower face of the plate.

The longitudinal extent of the chamber is such as to take in at least two holes, the distance between the holes being less than the diameter of the cup.

The sliding distributor block 15*a* is mounted on the slide 5 so as to be movable along the plate-holding table together with the inking cup.

The sliding distributor block as a whole, complete with the chamber and the lip, is preferably of a size such that the resultant of the thrust exerted by the air on the plate-holding table from below balances the force which the spring exerts on the cup, and hence on the table, from above. The vertical forces which act on the slide by reaction are consequently also balanced.

In operation, air is blown towards the cup, onto the lower face of the plate so that the portion 6*a* of the plate which is delimited by the cup is deformed by bulging from below towards the inside of the cup.

As a result of this bulging of the portion 6*a* of the plate inside the cup, a domed portion of the plate is formed with an angular point in the plate adjacent the peripheral lip. This deformation of the plate and, in particular, the angular point adjacent the lip, brings about an unusual increase in the sealing between the lip and the plate.

The main advantage of the invention lies in the fact that it has achieved an unusual improvement in the sealing between the inking cup and the plate and consequently a lower consumption of ink and particularly of solvent, as well as improved print quality.

A further advantage of the invention lies in its structural simplicity so that fully reliable operation of the inking device can be expected over a protracted period of time.

Naturally, an expert in the art will be able to apply to the invention described above many modifications and variations all of which, however, are included in the scope of protection of the invention as defined by the following claims.

It is claimed:

1. A method of ensuring sealing between a plate disposed above a plate-holding table of a pad-transfer printing machine and an inking cup movable along the table in pressing contact with an upper face of the plate, characterized in that it comprises the step of pneumatically deforming the plate towards the inside of the cup.

2. A method according to claim 1, characterized in that the step of pneumatically deforming the plate is carried out by the creation of a vacuum in the inking cup.

3. A method according to claim 2, characterized in that the vacuum is created by placing the cup in fluid communication with a vacuum source.

4. A method according to claim 1, characterized in that the step of pneumatically deforming the plate is carried out by blowing air towards the cup from a lower face of the plate.

5. A method according to claim 4, characterized in that the air-blowing step is carried out by the provision of a source of compressed air disposed beneath the table and movable to and fro together with the cup, as well as a plurality of holes distributed along the plate-holding table for putting the source of compressed air into communication with the lower face of the plate.

6. An inking device for a pad-transfer printing machine of the type comprising a plate-holding table, a plate disposed above the table, and an inking cup movable along the table in pressing contact with an upper face of the plate, characterized in that it comprises pneumatic means active on the plate in order to deform it towards the inside of the cup.

7. An inking device according to claim 6, characterized in that the pneumatic means comprise a vacuum source in fluid communication with the cup.

8. An inking device according to claim 6, characterized in that the pneumatic means comprise a compressed-air source disposed beneath the table and movable with the cup, as well as a plurality of holes distributed along the table for putting the compressed-air source into communication with a lower face of the plate.

9. An inking device according to claim 8, characterized in that the compressed-air source comprises a sliding distributor block having a chamber taking in at least two holes and a sealing lip in sliding contact with the table.

* * * * *